US012297525B2

(12) United States Patent
Yoshihara et al.

(10) Patent No.: US 12,297,525 B2
(45) Date of Patent: May 13, 2025

(54) MANUFACTURING METHOD FOR NICKEL-BASED ALLOY PRODUCT OR TITANIUM-BASED ALLOY PRODUCT

(71) Applicant: PROTERIAL, LTD., Tokyo (JP)

(72) Inventors: Mari Yoshihara, Tokyo (JP); Takuya Murai, Tokyo (JP); Tadashi Fukuda, Tokyo (JP); Shoichi Takahashi, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 415 days.

(21) Appl. No.: 17/776,163

(22) PCT Filed: Nov. 26, 2020

(86) PCT No.: PCT/JP2020/043993
§ 371 (c)(1),
(2) Date: May 11, 2022

(87) PCT Pub. No.: WO2021/106999
PCT Pub. Date: Jun. 3, 2021

(65) Prior Publication Data

US 2022/0403493 A1 Dec. 22, 2022

(30) Foreign Application Priority Data

Nov. 28, 2019 (JP) ..... 2019-215266

(51) Int. Cl.
*C22F 1/02* (2006.01)
*C22F 1/00* (2006.01)
(Continued)

(52) U.S. Cl.
CPC ..... *C22F 1/002* (2013.01); *C22F 1/10* (2013.01); *C22F 1/183* (2013.01)

(58) Field of Classification Search
CPC . C22F 1/002; C22F 1/10; C22F 1/183; C21D 2221/00; C21D 1/62
See application file for complete search history.

(56) References Cited

U.S. PATENT DOCUMENTS 4,842,652 A 6/1989 Smith et al.
5,419,792 A 5/1995 King et al.
(Continued)

FOREIGN PATENT DOCUMENTS

EP 0284876 A1 10/1988
EP 3290536 A1 3/2018
(Continued)

OTHER PUBLICATIONS

"Communication with Supplementary European Search Report", EP Application No. 20892472.0, Nov. 17, 2022, 10 pp.
(Continued)

*Primary Examiner* — Anthony M Liang
*Assistant Examiner* — Danny N Kang
(74) *Attorney, Agent, or Firm* — Myers Bigel, P.A.

(57) ABSTRACT

Provided is a method for producing a Ni- or Ti-based alloy product, the method capable of reliably locally cooling and effectively cooling. The method includes the steps: heating and holding a hot working material of a Ni- or Ti-based alloy after hot forging or hot ring rolling at a solution treatment temperature to obtain a material held in a heated state, and cooling the material held in a heated state to obtain a solution-treated material. The cooling step includes carrying out local cooling by contacting a cooling member with a part of a surface of the material held in a heated state.

4 Claims, 3 Drawing Sheets

(51) Int. Cl.
*C22F 1/10* (2006.01)
*C22F 1/18* (2006.01)

(56) References Cited

U.S. PATENT DOCUMENTS

| | | | |
|---|---|---|---|
| 2003/0098106 | A1 | 5/2003 | Rabinovich et al. |
| 2005/0012250 | A1 | 1/2005 | Rabinovich |
| 2005/0056354 | A1 | 3/2005 | Groh et al. |
| 2007/0113937 | A1 | 5/2007 | Rabinovich |
| 2013/0333190 | A1 | 12/2013 | Mizumura et al. |
| 2017/0081748 | A1 | 3/2017 | Adam et al. |

FOREIGN PATENT DOCUMENTS

| | | | | |
|---|---|---|---|---|
| JP | H10331659 | A | | 12/1998 |
| JP | 2000080458 | A | * | 3/2000 |
| JP | 2003221617 | A | | 8/2003 |
| JP | 2005036318 | A | | 2/2005 |
| JP | 2017515689 | A | | 6/2017 |
| WO | 2012118223 | A1 | | 9/2012 |
| WO | 2015136299 | A2 | | 9/2015 |

OTHER PUBLICATIONS

"Communication with Supplementary European Search Report", EP Application No. 20892781.4, Dec. 12, 2022, 9 pp.

"English language translation of International Search Report", International Application No. PCT/JP2020/043993, Feb. 9, 2021, 2 pp.

"English language translation of International Search Report", International Application No. PCT/JP2020/043991, Feb. 9, 2021, 2 pp.

* cited by examiner

MANUFACTURING METHOD FOR NICKEL-BASED ALLOY PRODUCT OR TITANIUM-BASED ALLOY PRODUCT

RELATED APPLICATIONS

This application is a 35 U.S.C. § 371 national stage application of PCT Application No. PCT/JP2020/043993, filed on Nov. 26, 2020, which claims priority from Japanese Patent Application No. 2019-215266, filed on Nov. 28, 2019, the contents of which are incorporated herein by reference in their entireties. The above-referenced PCT International Application was published in the Japanese language as International Publication No. WO 2021/106999 A1 on Jun. 3, 2021.

TECHNICAL FIELD

The present invention relates to a method for producing a nickel-based alloy product or a titanium-based alloy product.

BACKGROUND ART

When a solution treatment is carried out on a disk-shaped metal material that has been formed into a predetermined shape by hot forging or the like and is made of a nickel-based alloy or titanium-based alloy, such as an aircraft engine member, various types of cooling media such as water, oil, and air (including a forced convection air flow generated by a blowing fan or the like) are used in the cooling process. In order to impart a high strength characteristic by a heat treatment, it is desirable that the material be cooled at a high cooling rate in the solution treatment. On the other hand, the generation of residual stress caused by an uneven temperature distribution in the material due to rapid cooling may subsequently cause shape distortion in machining performed to obtain the final product or the like, and may adversely affect the strength characteristic of the product, for example, a fatigue characteristic. Therefore, particularly for materials that are required to be given a high strength level and are solution-treated at a high temperature, the use of a cooling medium that gives an excessively high cooling rate, such as water and oil, tends to be avoided.

Furthermore, for the purpose of reducing residual stress, it is desirable that the entirety of the material be cooled as uniformly as possible in the cooling process of the material, and accordingly, for a material having a complex shape, there is a need to locally preferentially cool a thick portion, which is relatively difficult to cool. For example, the cooling rate of the entirety of the disk-shaped metal material is controlled by spraying a gas such as air from a plurality of high-pressure nozzles that are close to the site where the disk-shaped metal material is to be locally cooled, and a freely selected site of a material held in a heated state is thus rapidly cooled to achieve the desired cooling rate. In addition to air, a liquid refrigerant such as water may be sprayed along with the gas.

REFERENCE DOCUMENT LIST

Patent Document

Patent Document 1: JP 2005-36318 A
Patent Document 2: JP 2003-221617 A

SUMMARY OF THE INVENTION

Problem to be Solved by the Invention

When air is blown by a fan or high-pressure air is sprayed from nozzles, it is difficult to increase the cooling rate to the desired range at the location to be cooled, since the density and specific heat of the air are low.

On the other hand, when a refrigerant such as water is sprayed simultaneously with a gas such as air, the refrigerant sprayed onto the workpiece has a certain dispersion, and there is a cooling effect due to latent heat of evaporation. Accordingly, it is difficult to strictly control a cooling site and cooling rate.

Furthermore, when a refrigerant such as water is sprayed simultaneously with a gas such as air, a large amount of vapor is generated, in addition to the dispersion of the refrigerant due to spraying, and this vapor also disperses. Accordingly, it is difficult to estimate the effect of the vapor at the position to be sprayed, and it is more difficult to locally control the cooling rate.

An object of the present invention is to provide a method for producing a nickel-based alloy product or a titanium-based alloy product, the method reliably enabling local cooling to perform effective cooling.

Means for Solving the Problem

The present invention has been made in view of the problems described above.

The present invention is a method for producing a nickel-based alloy product or a titanium-based alloy product, including: a heating and holding step of heating and holding a hot working material of a nickel-based alloy or a titanium-based alloy after hot forging or hot ring rolling at a solution treatment temperature to obtain a material held in a heated state; and a cooling step of cooling the material held in a heated state to obtain a solution-treated material, in which the cooling step includes carrying out local cooling by contacting a cooling member with a part of a surface of the material held in a heated state.

It is preferable that the cooling member be worked into a shape in which a contact surface of the cooling member in contact with the part of the surface of the material held in a heated state matches the shape of the part to be locally cooled of the material held in a heated state.

It is preferable that the local cooling be carried out by contacting the cooling member with the part of the surface of the material held in a heated state at a surface pressure of at least 0.01 MPa.

Effects of the Invention

According to the present invention, local cooling can be reliably achieved to carry out effective cooling even for a material to be treated having a complex shape, such as disk-shaped metal material.

MODE FOR CARRYING OUT THE INVENTION

Figure 1A:
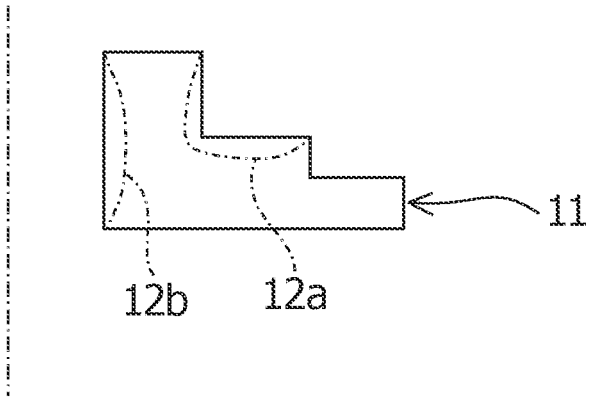
FIGS. 1A and 1B are cross-sectional schematic diagrams showing an example of a method of cooling a material held in a heated state according to the present invention.

First, in the present invention, it is preferable to work a hot working material of a nickel-based alloy or a titanium-based alloy after hot forging or hot ring rolling into a predetermined shape in advance to thereby obtain a material to be subjected to solution treatment.

Typical examples of hot forging include die forging. As used herein, "die forging" is forging that enables forming into a shape close to the final product by upper and lower dies. "Hot forging" includes isothermal forging, in which the forging temperature and the temperature of the metal die are almost the same temperature, and hot die forging, in which the die temperature is set lower than in iswothermal forging. In hot ring rolling, the height of a ring-shaped rolling material is pressed while expanding the diameter of the rolling material using a ring rolling mill having at least a main roll, a mandrel roll, and a pair of axial rolls to hot roll a ring-shaped rolling material. The hot working material as the object in the present invention is a material in which thickness changes as viewed on a cross section of the hot working material.

The hot working material formed into a predetermined shape by the hot working is worked into a predetermined shape in advance. The purpose of this working is, for example, to remove a relatively thick oxidized scale formed during the hot working or modify the contour of the surface of the hot working material by machining such as grinding, cutting, or blasting treatment, so that the contact state between a cooling member, which is described later, and a material held in a heated state when they are in contact can be managed to strictly control the state of cooling of the material held in a heated state due to heat transfer between the cooling member and the material held in a heated state.

In a case of carrying out the solution treatment in an oxidizing atmosphere such as in air, if the roughness of the machined surface is too great, the surface area increases, which may increase the amount of oxidized scale formed during heating and holding at the time of the solution treatment. As a result, the contact state between the cooling member and the material held in a heated state may be incomplete, and heat transfer to the cooling member may be inhibited by a thick oxidation scale. Therefore, it is desirable that the surface be a smooth surface having a standard finish or a finer level in terms of roughness (for example, preferably a surface roughness Ra of 5 to 13 μm).

As used herein, "nickel-based alloy" is an alloy for use in a high temperature region of 600° C. or higher, which is also referred to as a superalloy or heat-resistant superalloy, and is an alloy strengthened by a precipitation phase such as γ'. Typical alloys include 718 alloys and Waspaloy alloys. In addition, 64Ti is an example of a typical titanium-based alloy.

Heating and Holding Step

The material to be subjected to solution treatment, which is obtained by machining the hot working material, is heated and held at a predetermined temperature to obtain a material held in a heated state. The heating temperature and holding time depend on the kind and size of the material, but for example, a temperature range of about 900 to 1200° C. and a time of about 0.5 to 6 hours are acceptable for a nickel-based alloy. For a titanium-based alloy, a temperature range of about 700 to 1000° C., and a time of about 0.5 to 6 hours are acceptable.

Cooling Step

The material held in a heated state, which is heated and held at the above-described solution treatment temperature, is cooled to obtain a solution-treated material. Since the cooling step is the most characteristic step of the present invention, the cooling step will be described with reference to the drawings.

Figure 1B:
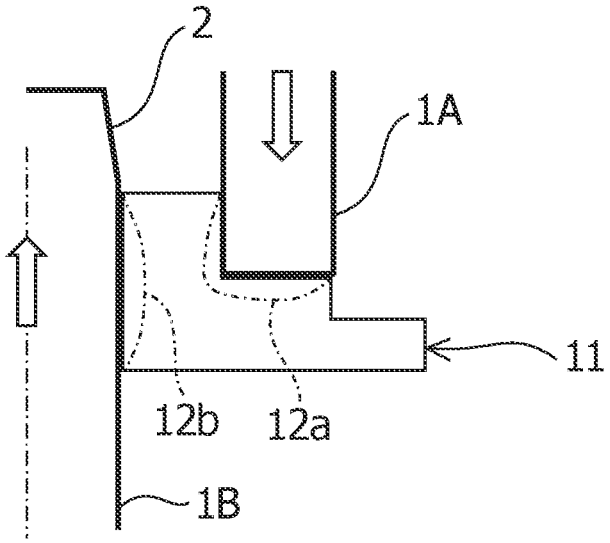

FIGS. 1A and 1B are cross-sectional schematic diagrams showing, in a simplified manner, an example of the step of cooling the disk-shaped metal material (material held in a heated state 11) according to the present invention. FIG. 1A is a cross-sectional schematic diagram of the material held in a heated state 11 before contact with a cooling member 1, and FIG. 1B is a cross-sectional schematic diagram when in contact with the cooling member 1. The region of the surface of the material held in a heated state 11 shown by the dashed line of FIG. 1A is a part where local cooling is carried out (locally cooled part 12).

As shown in FIGS. 1A and 1B, a cooling member 1A is in direct contact with a site where local cooling of the material held in a heated state 11 is to be carried out (for example, a stepped shape part 12*a* having different thicknesses of the material held in a heated state 11), and a predetermined site of the material held in a heated state is locally cooled. The shape and surface roughness of the surface of the material held in a heated state 11 are modified by machining or the like to ensure a good contact state between the cooling member 1 and the material held in a heated state 11. The cooling member 1 is modified in advance by working it into a predetermined shape so that it can be in contact with the material held in a heated state while following its shape.

This part where local cooling is preferentially carried out is a part where the flow of the sprayed gas is otherwise inhibited during the conventional cooling process in a solution treatment. In the present invention, it is possible to preferentially cool the predetermined site, due to the fact that the cooling member is in direct contact with the material held in a heated state. Specifically, the contact surface of the cooling member 1 is worked into a shape that matches the shape of the locally cooled part 12, where the local cooling of the material held in a heated state 11 is to be performed. For example, the cooling member 1 may have a single surface or a plurality of surfaces as the contact surface. The contact surface may be a flat surface such as a circle, an arc, a ring, a square, or a polygon; a curved surface such as an outer circumferential surface of a cylinder, an inner circumferential surface of a cylinder, an outer circumferential surface of a cone, an inner circumferential surface of a cone, or a combination thereof.

When contacting the cooling member with the material held in a heated state, a cooling capacity equal to or greater than that in local cooling technique using air can be achieved by controlling the contact surface pressure between the cooling member and the material held in a heated state such that the contact surface pressure is at least 0.01 MPa and is equal to or less than the high-temperature creep strength and high-temperature compression resistance of the material held in a heated state.

In view of increasing the cooling rate at the part of the material held in a heated state in contact with the cooling member, the contact surface pressure is preferably at least 0.05 MPa, more preferably at least 0.15 MPa, and further preferably at least 0.25 MPa. The upper limit of the contact surface pressure is not particularly limited, and it may be determined by taking into consideration, for example, the kind of the material held in a heated state, the treatment temperature, and the compressive yield strength. The calculated upper limit may be up to 50 MPa; however, in actual practice, up to 10 MPa is acceptable, up to 5 MPa is preferable, and up to 2 MPa is more preferable.

To adjust the contact surface pressure in this way, the weight of the cooling member itself may be changed, or a member for which weight can be changed, such as a weight different from the cooling member, may be placed on the cooling member, for example.

The center of the disk-like metal material as the material held in a heated state 11 shown in FIG. 1 has a ring shape with a through-hole formed therein by working. An inner circumferential surface 12*b* of the through-hole is also a part where the flow of the sprayed gas is otherwise inhibited during the conventional cooling process in a solution treatment. A cooling member 1B that cools the inside of this hole may include, for example, a tapered portion 2 formed by working the tip portion into a tapered shape so that it is easy to insert into the hole. Furthermore, by slightly tapering the shape of the cooling member 1B to contact the inner diameter surface of the material held in a heated state 11, the cooling member 1B inserted into the center portion can also function as a positioning member for centering.

The local cooling by the cooling member 1 may be effective until the temperature of the locally cooled part becomes equal to or less than a certain temperature. This temperature depends on the purpose for controlling the cooling rate of the material held in a heated state by the local cooling. For example, in the case of improving heterogeneity due to the precipitation behavior of the nickel alloy and the cooling temperature distribution of the material held in a heated state, the control of the cooling rate by local cooling functions sufficiently if the local cooling is effective until about 700° C. On the other hand, in the case of improving the heterogeneity of a strain distribution due to heat shrinkage during cooling of the material held in a heated state, the local cooling needs to be effective as far as a temperature range below 700° C. The contact cooling with the cooling member may be combined with normal cooling with a refrigerant such as air or water. When normal cooling and the contact cooling with the cooling member according to the present invention are combined, the material held in a heated state can be continuously locally cooled regardless of the heat capacity (volume) of the cooling member, which also gives the advantages of simplifying the structure and space-saving in cooling device design.

The cooling member will now be described in detail.

In the present invention, the cooling member functions as a so-called heat sink. Therefore, in view of the heat sink function, the heat flux during cooling can be controlled to some extent by adjusting, for example, the kind, size (volume), and shape of the cooling member, the surface roughness, and the surface pressure of the contact portion. In particular, by modifying the shape and volume of the cooling member and forecasting by calculation in advance how the cooling member will become hot due to contact with the material held in a heated state, the cooling rate can be controlled according to the temperature condition of the material held in a heated state during cooling. For example, in order to increase the cooling rate, a flow path for a cooling medium may be provided inside the cooling member, or a fin or the like may be provided in a part of the cooling member for air cooling. As a result, the cooling member can serve a function as a heat medium (conductor) that increases the heat transfer coefficient to the external cooling medium.

In addition, the material of the portion of the cooling member that contacts the material held in a heated state is required, for example, to have high thermal conductivity, to have a melting point that exceeds the solution treatment temperature, not to change or contaminate the material held in a heated state, and not to deform the material held in a heated state. Therefore, it is advisable to appropriately select the material from metal materials that satisfy these requirements. For superalloys (for example, Ni-based heat-resistant alloys and Co-based heat-resistant alloys) used for aircraft engine members, a material that is slightly inferior in high-temperature strength to the superalloy (that is, a material that is easily deformed so as to be in close contact) is desirable in view of improving the adhesion state when the cooling member is in contact with the material held in a heated state. From these viewpoints, preferable materials for the cooling member are, for example, pure Ni, a Ni-based alloy having a content of elements other than Ni of up to 10% by mass, and a Fe-based alloy.

The cooling member can be an assembly of two or more parts. As described above, for the portions of the cooling member that are to be in contact with the material held in a heated state, the material of the cooling member is required to have characteristics such that the materials of both are a suitable combination. On the other hand, for the portions that are not to be in direct contact with the material held in a heated state, a metal material that has excellent thermal conductivity and a large specific heat, such as an Al-based or Cu-based material, can be used, which serves as the portion that utilizes the heat capacity. In this case, the joining surface of the portion in direct contact with the material held in a heated state to the metal material having a high thermal conductivity may be a barrier to heat transfer. Accordingly, the joining surface should be designed such that the joining surface has a complex interface shape that can increase the contact area as much as possible and also such that different types of materials can be joined with a constant load. For example, instead of joining simple flat surfaces together, tapered cone-shaped joining surfaces are used, and the parts are firmly joined to each other with fastening parts such as bolts. In the case of welding, it is advisable to weld so that there are no voids, cracks, or the like. In particular, joining together the parts with fastening parts is economically efficient for the following reasons: the joining load can be controlled relatively strictly by the fastening torque, and detachability is good, so the parts can be replaced on a part-by-part basis.

It is also possible to sandwich an intermediate substance that improves heat transfer between the joining surfaces of the parts. This intermediate substance is not limited to a solid, and may be in the form of a gel or a clay. For example, a paste containing Ag, Al, or C can also be applied depending on the conditions of use.

In the working of the surface of the cooling member that is to be in contact with the material held in a heated state, extremely small protrusions can be formed on the surface of the cooling member, for example. Those protrusions are crushed at the time of contact with the high temperature material held in a heated state, thereby improving the close-contact state, which enables a highly close-contact state during contact with the cooling member.

According to this embodiment, the contact state between the material held in a heated state and the cooling member can be visually confirmed and managed by observing the deformed state of the protrusions after cooling.

Examples

Hereinafter, examples and comparative examples of the present invention will be described.

First, as the hot working material, a disk-shaped material to be subjected to solution treatment having a diameter of 220 mm and a thickness of 40 mm was obtained from a forged round bar of a nickel-based heat-resistant superalloy (718 alloy) having a diameter of 260 mm by machining involving saw cutting and turning. The surface on the side that was to be in contact with the cooling member 20, which will be described later, was finish to a standard finish level with a surface roughness Ra of 6.3 μm. Next, this material to be subjected to solution treatment was heated to a solution treatment temperature of 1120° C. and held at uniform heat for 70 to 100 minutes to obtain a material held in a heated state. Then, a cooling test for obtaining a solution-treated material was carried out by cooling this material held in a heated state with the cooling member. A schematic cross-section of the cooling test is shown in FIG. 2.

Figure 2:
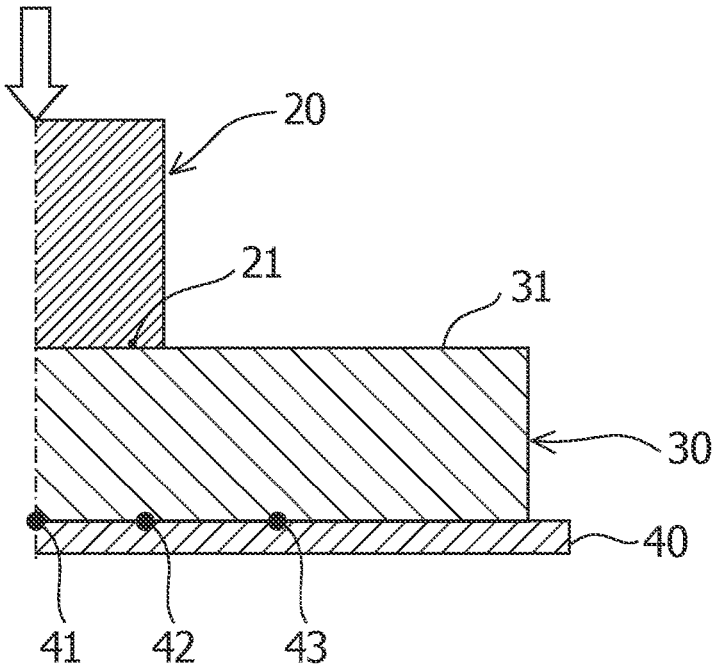
FIG. 2 is a cross-sectional diagram schematically showing a state in which a cooling member is in contact with the material held in a heated state in a cooling test in Examples.

As shown in FIG. 2, the cooling member 20 had a cylindrical shape with a diameter of 70 mm. The surface at one end served as a contact surface 21 with the material held in a heated state 30. The material of the cooling member 20 was a pure nickel forging material, and the weight was about 6 kg. The contact surface 21 was finished to an almost same surface roughness as that of the material held in a heated state 30 by turning. Furthermore, a weight made of carbon steel (SS400) for general structural use (not shown) was used to adjust the surface pressure when the cooling member 20 and the material held in a heated state 30 were in contact.

For the cooling test, the contact surface of the cooling member was worked into a shape matching the shape of the part to be locally cooled of the material held in a heated state. As shown in FIG. 2, the material held in a heated state 30 was placed on an insulating material 40, and the cooling member 20 was placed on the material held in a heated state 30 with the contact surface 31 of the cooling member 20 in contact with the surface 31 of the material held in a heated state 30 so that the center of the disk-shaped material held in a heated state 30 matched the center of the cylindrical cooling member 20. Furthermore, the contact surface pressure of the cooling member 20 against the material held in a heated state 30 was adjusted using a weight. Then, cooling was performed until the temperature of the measurement site was 500° C. or lower. The time taken to convey the material held in a heated state from the completion of the solution treatment to the start of cooling was 24 to 34 seconds. As for the temperature measuring method, thermocouples (K type thermocouples) 41, 42, and 43 were attached to, and contacted with, the rear surface of the material held in a heated state 30 (also in contact with the insulation material 40). The measurement positions were the center position of the disk-shaped material held in a heated state 30, a position 30 mm from the center, and a position 60 mm from the center. The cooling experiment was performed at a contact surface pressure of up to 1 MPa, and specifically, under two conditions: 0.25 MPa and 0.05 MPa. The results are shown in Table 1 and FIGS. 3 to 5. Furthermore, the results of a comparative example, in which the material held in a heated state was left to cool without using the cooling member, are also shown.

TABLE 1

| | Contact surface pressure [MPa] | Maximum cooling rate at center position [° C./sec] | Average cooling rate from 1100° C. to 700° C. [° C./sec] 0 mm (center) | 30 mm | 60 mm |
|---|---|---|---|---|---|
| Example 1 | 0.25 | 1.20 | 0.59 | 0.55 | 0.51 |
| Example 2 | 0.05 | 1.00 | 0.54 | 0.52 | 0.51 |
| Comparative Example (left to cool) | — | 0.65 | 0.48 | 0.49 | 0.52 |

Figure 3:
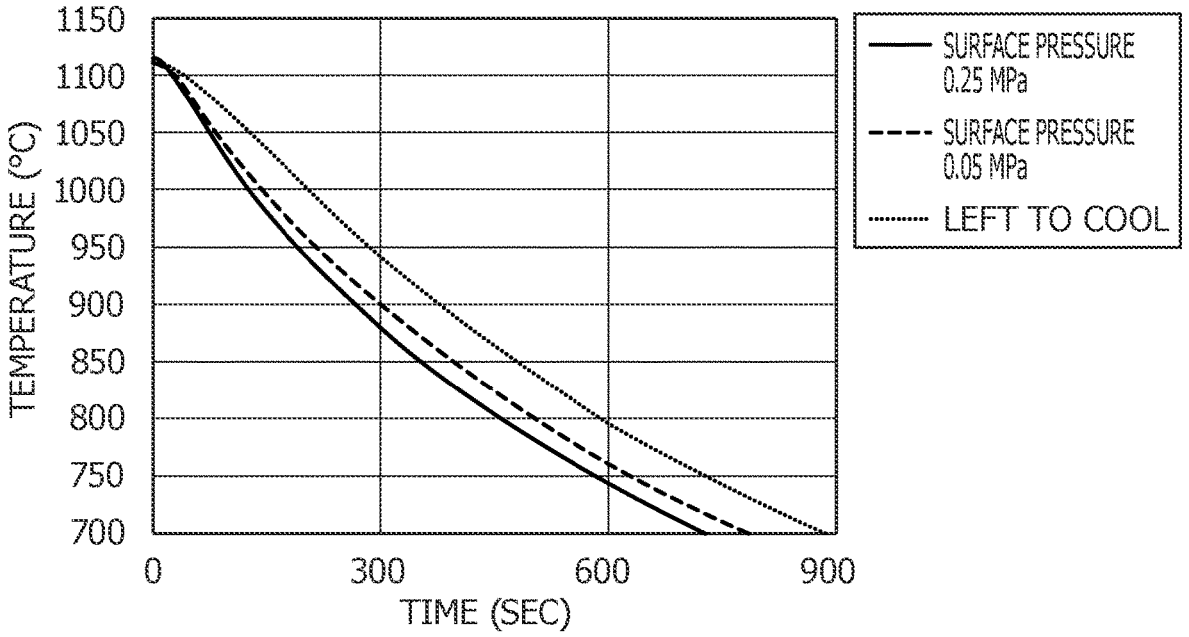
FIG. 3 is a graph showing the change over time in temperature at a center position of the material held in a heated state, as results of the cooling test in Examples and Comparative Example.

In Examples 1 and 2, in which cooling was performed using the cooling member, cooling from 1100° C. to 700° C. after the start of cooling from 1120° C. at the center position of the material held in a heated state was achieved over a time of about 680 to 740 seconds, as shown in FIG. 3. On the other hand, in Comparative Example, in which the material held in a heated state was left to cool, cooling took 840 seconds. Furthermore, in Examples 1 and 2, in which cooling was performed using the cooling member, a maximum cooling rate of about 1.0 to 1.2° C./s was observed when the temperature of the material held in a heated state was about 1100° C. at the center position of the material held in a heated state, as shown in Table 1 and FIG. 4. On the other hand, in the Comparative Example, in which the material held in a heated state was left to cool, the maximum cooling rate was about 0.65° C./s when the temperature of the material held in a heated state was about 1050° C. Thus, it was confirmed that using the cooling member enables significant increase in the cooling rate at the part of the material held in a heated state in contact with the cooling member.

Figure 4:
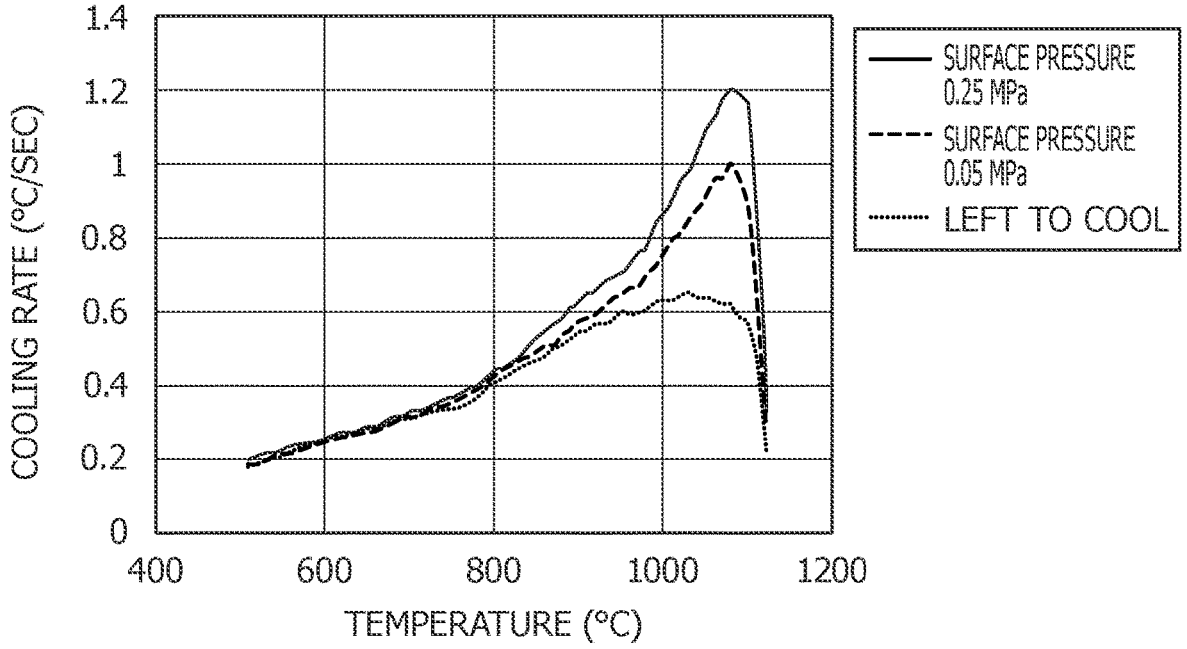
FIG. 4 is a graph showing the change in cooling rate versus temperature during cooling at a center position of the material held in a heated state, as results of the cooling test in Examples and a Comparative Example.

In addition, as shown in FIG. 4, the cooling rate rapidly increased in the initial stage at the start of cooling both in the Examples and in the Comparative Example. This is presumed to be largely influenced by heat radiation from the material held in a heated state. Furthermore, in all of the Examples 1 and 2 and the Comparative Example, the cooling rate gradually decreased after recording the maximum cooling rate, and at about 700° C., the cooling rates were almost the same. The reason for this is probably that the heat sink effect of the cooling member ran out at about 700° C. This indicates that it is possible to freely control the temperature range and time period in which the cooling rate is to be improved by appropriately adjusting the heat capacity of the cooling member, and that it is possible to freely adjust the cooling rate of a predetermined part by adjusting the contact surface pressure.

Figure 5:
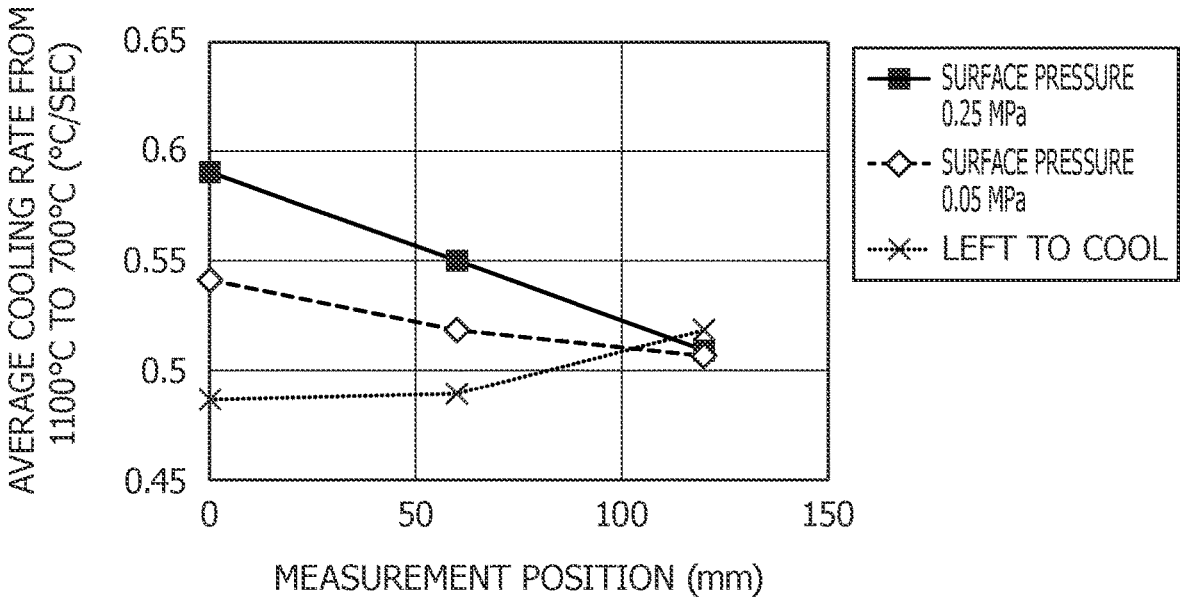
FIG. 5 is a graph showing the average cooling rate from 1100° C. to 700° C. at positions of 0, 30, and 60 mm from the center of the material held in a heated state, as results of the cooling tests in Examples and a Comparative Example.

In the Comparative Example, in which the material held in a heated state was left to cool, the average cooling rate from 1100° C. to 700° C. was higher in order of the positions 60, 30, and 0 mm from the center of the material held in a heated state, as shown in FIG. 5, and so the cooling rate was higher on the outer side of the material held in a heated state. In other words, the center of material held in a heated state had a relatively low cooling rate. On the other hand, in Examples, in which the cooling member was in contact with the center of the material held in a heated state, the average cooling rate from 1100° C. to 700° C. was higher in order of the positions 0, 30, and 60 mm from the center of the material held in a heated state. Therefore, it was confirmed that by using the cooling member, the cooling rate at the part of the material held in a heated state in contact with the cooling member and the periphery thereof can be effectively increased at a contact pressure of MPa or less, and that the cooling rate of the part to be preferentially, or locally, cooled can thus be effectively increased.

The part to be cooled of the material held in a heated state has a flat shape in this case; however, even if the part to be cooled has, for example, a curved shape or a complex shape, the above-mentioned effect can be obtained by working the contact surface of the cooling member into a shape that matches the shape of the part to be locally cooled of the material held in a heated state.

In the local cooling by contacting the cooling member according to the present invention as described above, modifying the shape of the contact portion of the cooling member enables selective cooling, compared to other cooling methods using a fluid such as air or water, and such selective cooling enables more precisely selecting and cooling a desired site of the material held in a heated state.

INDUSTRIAL APPLICABILITY

The cooling using the cooling member according to the present invention can be expected to be applied not only to Ni-based alloys and Ti-based alloys, but also to other alloys as well.

REFERENCE SYMBOL LIST

1: Cooling member
2: Tapered member
11: Material held in a heated state
12: Locally cooled part
20: Cooling member
30: Material held in a heated state
40: Insulation material
41, 42, 43: Thermocouple

The invention claimed is:

1. A method for producing a nickel-based alloy product or a titanium-based alloy product, comprising:

a heating and holding step of heating and holding a hot working material of a nickel-based alloy or a titanium-based alloy after hot forging or hot ring rolling at a solution treatment temperature to obtain a material held in a heated state; and a cooling step of cooling the material held in a heated state to obtain a solution-treated material, wherein the cooling step comprises carrying out local cooling by contacting a cooling member with a part of a surface of the material held in a heated state.

2. The method for producing a nickel-based alloy product or a titanium-based alloy product according to claim 1, wherein the cooling member is worked into a shape in which a contact surface of the cooling member in contact with the part of the surface of the material held in a heated state matches a shape of the part to be locally cooled of the material held in a heated state.

3. The method for producing a nickel-based alloy product or a titanium-based alloy product according to claim 1, wherein the local cooling is carried out by contacting the cooling member with the part of the surface of the material held in a heated state at a surface pressure of at least 0.01 MPa.

4. The method for producing a nickel-based alloy product or a titanium-based alloy product according to claim 1, wherein an entirety of the material held in a heated state is uniformly cooled in the cooling step.

* * * * *